US006155680A

United States Patent [19]

Belon et al.

[11] Patent Number: 6,155,680

[45] Date of Patent: Dec. 5, 2000

[54] INK-JET PRINTER WITH STATIONARY PENS AND TWO-AXIS MEDIA DRIVE

[75] Inventors: Juan B. Belon, San Diego; David M. Petersen, Poway, both of Calif.

[73] Assignee: Hewlett-Packard Company, Palo Alto, Calif.

[21] Appl. No.: 09/237,994

[22] Filed: Jan. 26, 1999

Related U.S. Application Data

[63] Continuation-in-part of application No. 08/995,745, Dec. 19, 1997.

[51] Int. Cl.[7] ..... B41J 2/01

[52] U.S. Cl. ..... 347/104; 400/649; 271/225

[58] Field of Search ..... 33/1 M; 271/225, 271/230, 240, 255; 346/139 R; 347/101, 104, 105, 106; 400/623, 649, 651, 655

[56] References Cited

U.S. PATENT DOCUMENTS

| | | | |
|---|---|---|---|
| 3,900,098 | 8/1975 | Effinger | 197/143 |
| 4,357,619 | 11/1982 | Klockenbrink | 346/160 |
| 4,547,786 | 10/1985 | Logan et al. | 346/140 |
| 4,905,015 | 2/1990 | Sieber et al. | 346/1.1 |
| 5,019,004 | 5/1991 | Steiner et al. | 445/30 |
| 5,172,138 | 12/1992 | Okazawa et al. | 346/134 |
| 5,277,140 | 1/1994 | Nakagaki | 112/121.12 |
| 5,323,722 | 6/1994 | Goto et al. | 112/121.2 |
| 5,333,561 | 8/1994 | Katou | 112/121.14 |
| 5,357,859 | 10/1994 | Eckert | 101/228 |
| 5,480,132 | 1/1996 | Kiyohara et al. | 271/10.01 |
| 6,025,898 | 2/2000 | Kashiwazaki et al. | 349/106 |

*Primary Examiner*—Ren Yan

[57] ABSTRACT

An ink-jet printer includes a printer housing structure, and at least one immobile ink-jet pen including a nozzle array mounted to the housing structure at a print area, the pen remaining stationary during printing operations. A two axis media drive system includes a media drive roller structure which is rotatable to move the medium in a first axis relative to the print area to position the medium relative to the pen nozzle array for a given swath, and a translating media carriage, the drive roller structure supported by the media carriage. The carriage is mounted for translating movement along a second axis transverse to the first direction, to slew the media along the second axis during printing, and a motor system for rotating the media drive roller and for translating the carriage. The motor system is a single motor/encoder system for driving the carriage and the roller. A drive transmission connects the motor system to the carriage and drive roller, and operates in a carriage drive mode or in a roller drive mode. A service station is mounted on the moving carriage, and includes a set of wiper blades and capping elements to respectively wipe and cap the pen nozzle plates.

16 Claims, 14 Drawing Sheets

50
52
54
56
60
60"
70
72
76
76A
76B
76C
76D
76E
76F
76G
76H
76I
76J
74
52A
60'

INK-JET PRINTER WITH STATIONARY PENS AND TWO-AXIS MEDIA DRIVE

CROSS-REFERENCE TO RELATED APPLICATION

This is a continuation-in-part of application Ser. No. 08/995,745, filed on Dec. 19, 1997, and entitled "Stationary Pen Printer," the entire contents of which are incorporated herein by this reference.

This application is also related to co-pending application Ser. No. 09/238,822 filed concurrently herewith, entitled SERVICE STATION FOR PRINTER WITH IMMOBILE PENS AND METHOD OF SERVICING PENS, the entire contents of which are incorporated herein by this reference.

TECHNICAL FIELD OF THE INVENTION

This invention relates to ink-jet printing techniques, and more particularly to a printer in which the pens are held in fixed position and the print medium is moved in two directions to impart relative motion between the pens and the medium.

BACKGROUND OF THE INVENTION

Ink-jet printers typically use a mechanical architecture wherein a pen carriage holding one or more print pens, each with a nozzle array, is transported across a stationary print medium to print a swath onto the medium. The medium is advanced between print cycles by a paper advance system to position the medium for subsequent swaths. The paper advance system typically includes a primary drive roller and one or more paper pinching rollers which retain the paper against the drive roller.

There are several disadvantages to this typical mechanical architecture. Transporting the ink-jet pens requires that a volume of space be allocated above the print medium to allow the motion of the carriage and pens. This volume is usually greater than the orthogonal cross-sectional area of the pen multiplied by the medium print width plus two times the pen carriage volume (since the carriage travel through each edge of the medium print width must be taken into account). This volume is typically enclosed, requiring increased part size and cost. Electrical connections to the pen carriage require flexible cables which can survive the repetitive flexing of printing cycles, and require connectors at the main printed circuit assembly mounted to the printer chassis, both of which add to part cost. The moving trailing cable creates an antenna which can lead to electromagnetic radiation interference.

SUMMARY OF THE INVENTION

An ink-jet printer is described which includes one or more ink-jet pens which are immobile, and a two axis media drive system. Because the pens do not move, they can be positioned adjacent to or mounted on the printer main printed circuit assembly board to minimize or eliminate flexible pen interconnect cables. The two axis media drive system includes a media drive roller structure which is rotatable to move the medium in one direction to position the medium for a given swath. The media drive roller is integrated into a translating media carriage, which slews the media in an orthogonal direction at print speed during printing.

Thus, according to one aspect of the invention, an inkjet printer includes a printer housing structure, and at least one immobile ink-jet pen including a nozzle array mounted to the housing structure at a print area, the pen remaining stationary during printing operations. A two axis media drive system includes a media drive roller structure which is rotatable to move the medium in a first axis relative to the print area to position the medium relative to the pen nozzle array for a given swath, and a translating media carriage, the drive roller structure supported by the media carriage. The carriage is mounted for translating movement along a second axis transverse to the first direction, to slew the media along the second axis during printing, and a motor system for rotating the media drive roller and for translating the carriage.

According to another aspect of the invention, a method for ink-jet printing includes the steps of:

- providing an inkjet pen having an inkjet nozzle array plate;
- mounting the inkjet pen at an immobile position on a printer;
- providing a carriage including a platen surface for supporting the print medium during printing operations, the carriage including a rotatable drive roller engaging the print medium;
- moving the carriage and the print medium along a linear swath axis in relation to the nozzle array plate while holding the drive roller in a rotationally fixed position and operating the inkjet pen to eject droplets of ink to print at least a portion of a swath on the print medium; and
- rotating the drive roller to advance the print medium to a location for printing another swath.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENTS

Figure 1:
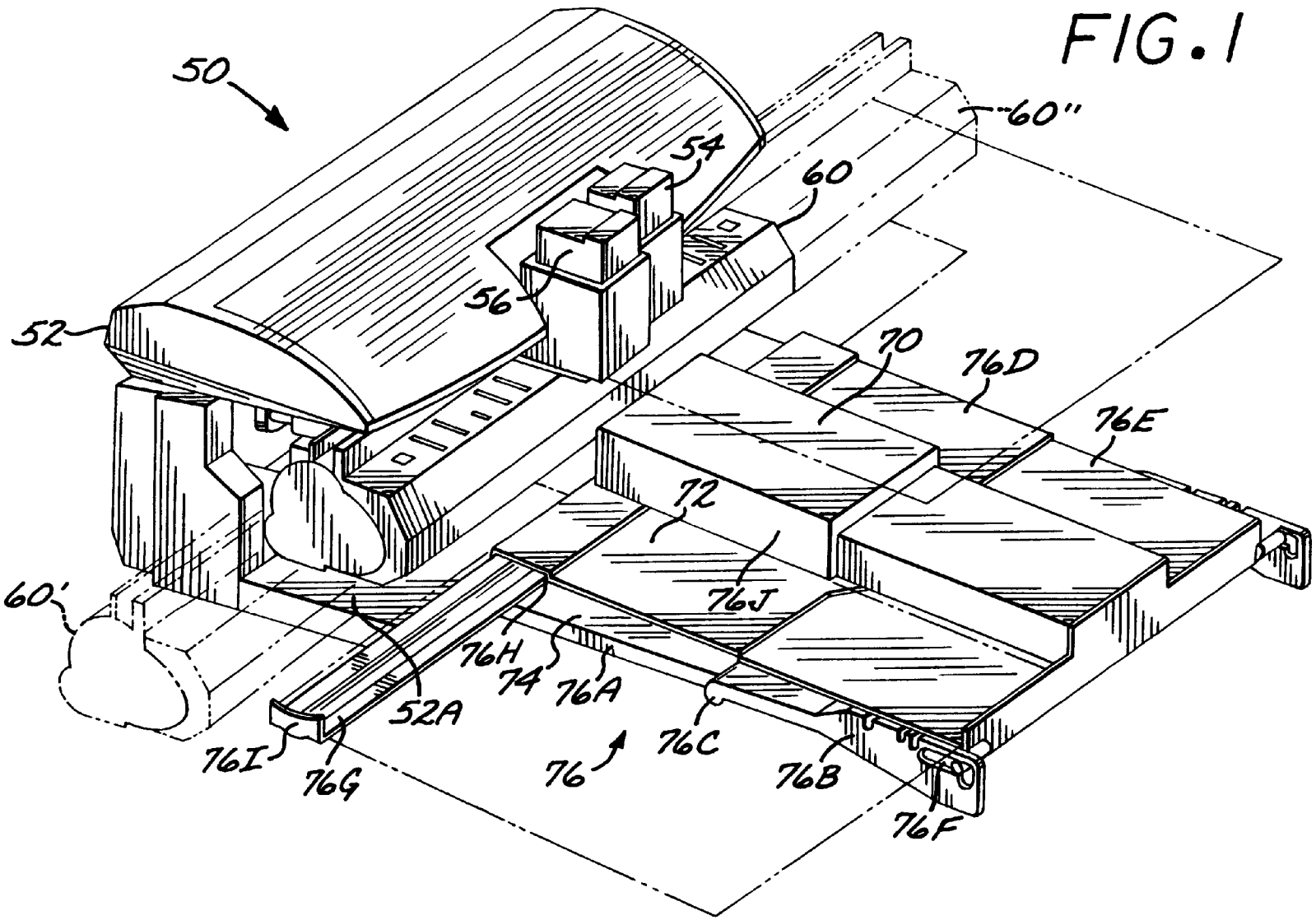
FIG. 1 is an isometric view of a printer embodying the invention.

FIG. 1 is an isometric view of an exemplary embodiment of an ink-jet printer 50 in accordance with the invention. The printer includes a housing structure indicated generally as 52, and two ink-jet pens 54, 56. In this embodiment, pen 54 is a black ink pen, with an internal reservoir holding black ink and a nozzle array on a nozzle plate 54A (FIG. 11) for emitting droplets of black ink onto the print medium, and pen 56 is a tri-color pen with three internal reservoirs and three corresponding nozzle arrays on a single nozzle plate 56A (FIG. 11) for emitting ink droplets of three different colors. The pens 54 and 56 are held in fixed position relative to the housing structure during printing operations on a print medium. The pens 54 and 56 are replaceable on their respective pen mounts, for replacement or refilling as needed.

The printer 50 includes a paper carriage 60 which includes a main drive roller structure (not visible in FIG. 1), print media control surfaces and a linear bushing system (FIGS. 10A–10B) to allow the carriage to slide orthogonally to the drive roller advance direction. The carriage 60 is translatable along a longitudinal axis of the carriage to slew the print medium held by the drive roller past the nozzle arrays of the pens 54, 56 during printing operations. This moment of the carriage is illustrated in FIG. 1, with a leftmost position of the carriage illustrated in phantom as 60', and a position of the carriage toward the right illustrated in phantom as 60". The leftmost position at 60' is a drop position for the carriage to drop a completed sheet at the output tray 74. The position 60" illustrates a position within the printing range of movement.

The printer includes an output support surface 70, an output tray 72 for receiving sheets of print media output from the printer upon completion of the printing on a medium sheet, and an input tray 74 for holding an input supply of print media in sheet form. In this exemplary embodiment, the input/output tray structure, generally indicated as structure 76 in FIG. 1, is designed of several parts which can be folded up to conserve space in shipping or when the printer is not in use. The structure includes input tray members 76A and 76B, which are connectable at joint 76C to form the input tray for the input stack of print media. Upper tray members 76D, 76E each have an raised portion, forming the output support surface 70. The upper tray members are formed so that member 76D can be telescoped to fit over member 76E. The tray member 76E is connected by hinge elements 76F inserted through open channels formed at the rear of the tray member 76B. This permits the upper tray members to be opened about the hinge members 76F to provide access to the input tray, e.g. to replenish the media input supply. The output stack location is further defined by an extendable pull-out support strut 76G which is supported in a channel, indicated generally as 76H, formed in the upper tray member 76D. The strut has an upstanding tab 76I formed at its exposed end, which together with the wall 76J of the raised portion forming the surface 70 defines the output stack location. While not shown in FIG. 1, a second support strut could be accommodated, to extend from the opposite side of the structure 76 from the strut 76G, to provide a means of holding output media at a second output stack location on the other side of the surface 70. All of the parts comprising the structure 76 can be fabricated of plastic material.

Figure 2:
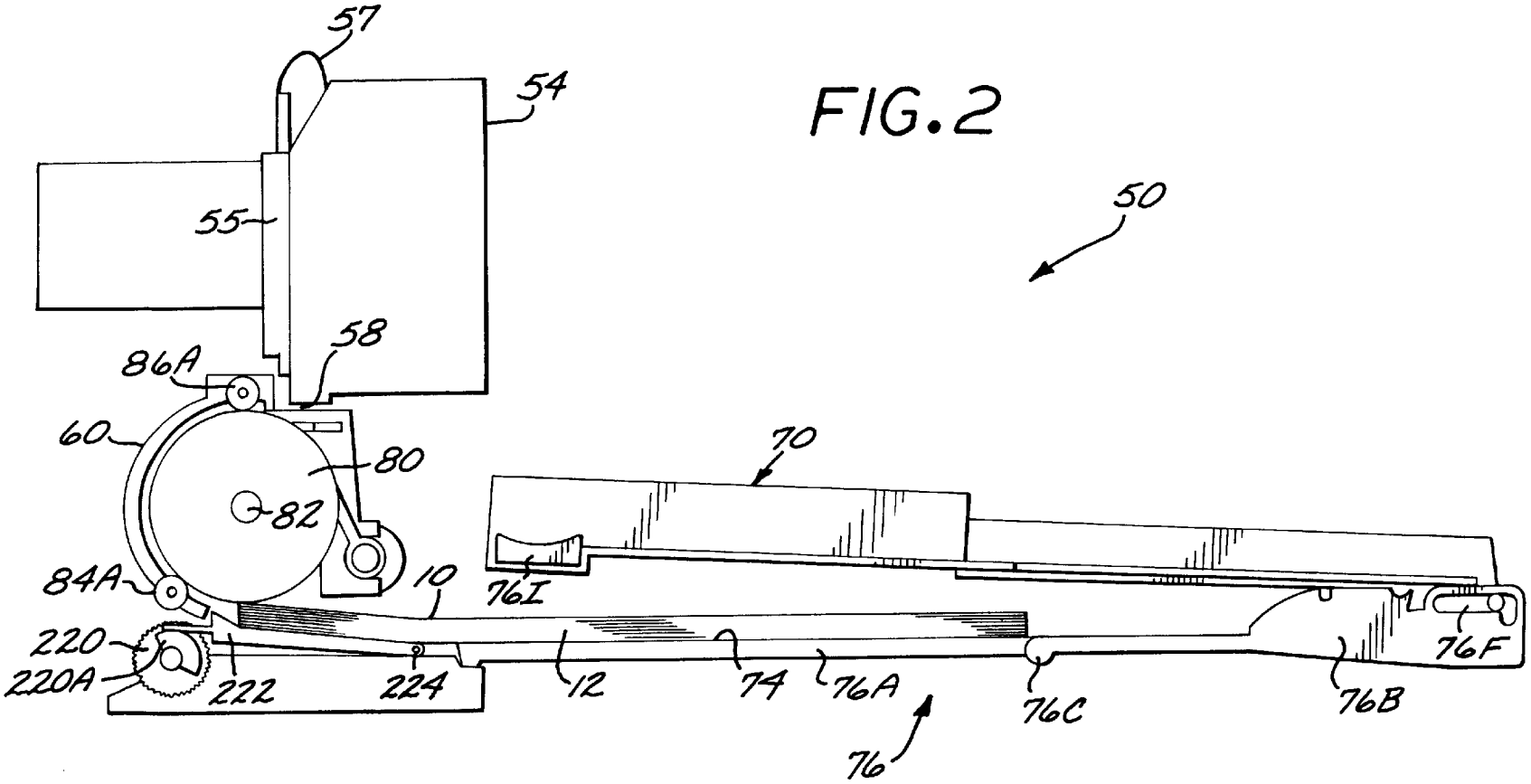
FIG. 2 is a diagrammatic side view illustrating the paper or media path through the printer of FIG. 1.

FIG. 2 is a diagrammatic side view of the paper path of the printer of FIG. 1. The drive roller 80 is mounted for rotation about a longitudinal shaft 82 within the carriage 60. The roller 80 in this exemplary embodiment is defined by a pair of roller tires 80A, 80B (FIG. 4) mounted on a roller shaft 82 in a spaced arrangement. Each tire has a high friction surface which engages the print medium. The print medium 10, e.g. a sheet of paper, is fed into the nip between a set of pinch rollers 84A, 84B and the high friction surfaces of the tires 80A, 80B comprising the drive roller 80, and the roller 80 is rotated to advance the leading edge of the paper sheet to the print zone 58 under the pen nozzle array. The paper moves tangentially to the roller circumferential surface as the roller rotates on its longitudinal axis, being guided by inner surfaces of the housing 60A. Thus, the paper 10 wraps around the drive roller and exits at the top under the pen nozzles at the print zone 58, after having passed through the nips between the roller tires 80A, 80B and a second set of idler rollers 86A, 86B.

Figure 3:
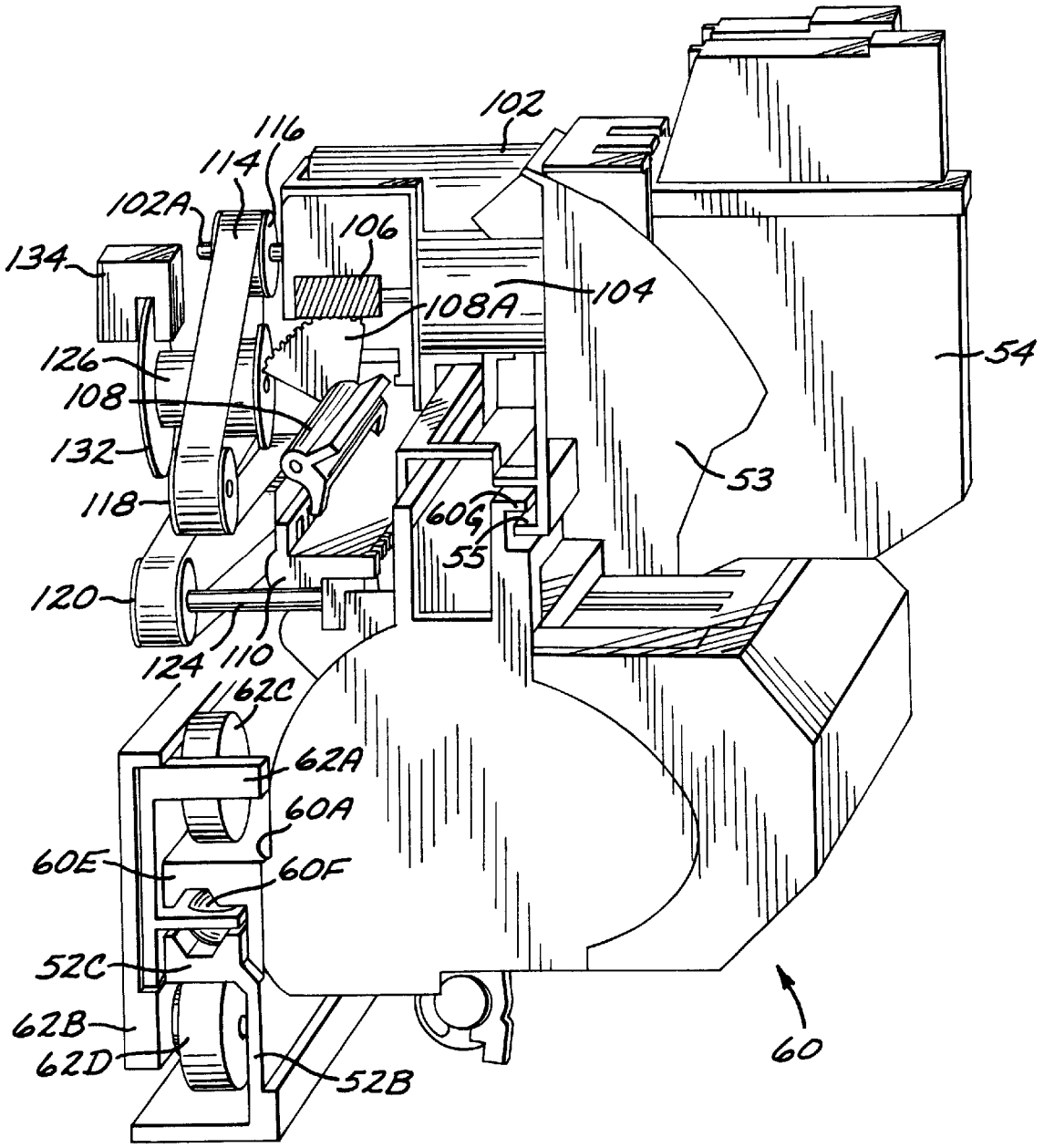
FIG. 3 is an isometric side view of the carriage and drive system of the printer of FIG. 1.

FIG. 3 is a diagrammatic isometric side view of a portion of the printer 50, illustrating aspects of the two-axis media drive system which provides motion between the immobile pens and the print media. The carriage 60 has a shell cover 60A and an end cover 60B. Attached to the shell cover 60A is an upper guide rail 60D having a ball race portion 60E. The printer housing structure 52 includes a floor 52A (FIG. 1) to which a lower guide rail 52B is attached. The lower guide rail has a ball race portion 52C. Two ball bearings 60F are captured between the corresponding ball race portions 60E, 52C of the guide rails 60D and 52B. A bearing cage 62A separates the bearings 60F, and supports top roller set 62C. A preload cage 62B support a lower roller set 62D and applies a preload force pushing the top roller set and the lower roller set toward each other. The top rollers roll on the flat surface of the upper rail as the carriage translates. The lower rollers roll on the flat surface of the lower rail as the carriage translates. Not shown is a compression preload spring between the cages.

The carriage 60 is further guided by a bushing arrangement at the back of the pen mounting structure. Protruding from the top of the carriage housing structure is a guide rail 60G which extends along the longitudinal extent of the carriage. The rail 60G rides in a bushing channel 55 defined at the back of the pen mount structure 53. The top bushing arrangement acts as an anti-rotation bushing, preventing clockwise (in the orientation of FIG. 3) rotation of the carriage about the bearings 60F.

Figure 11:
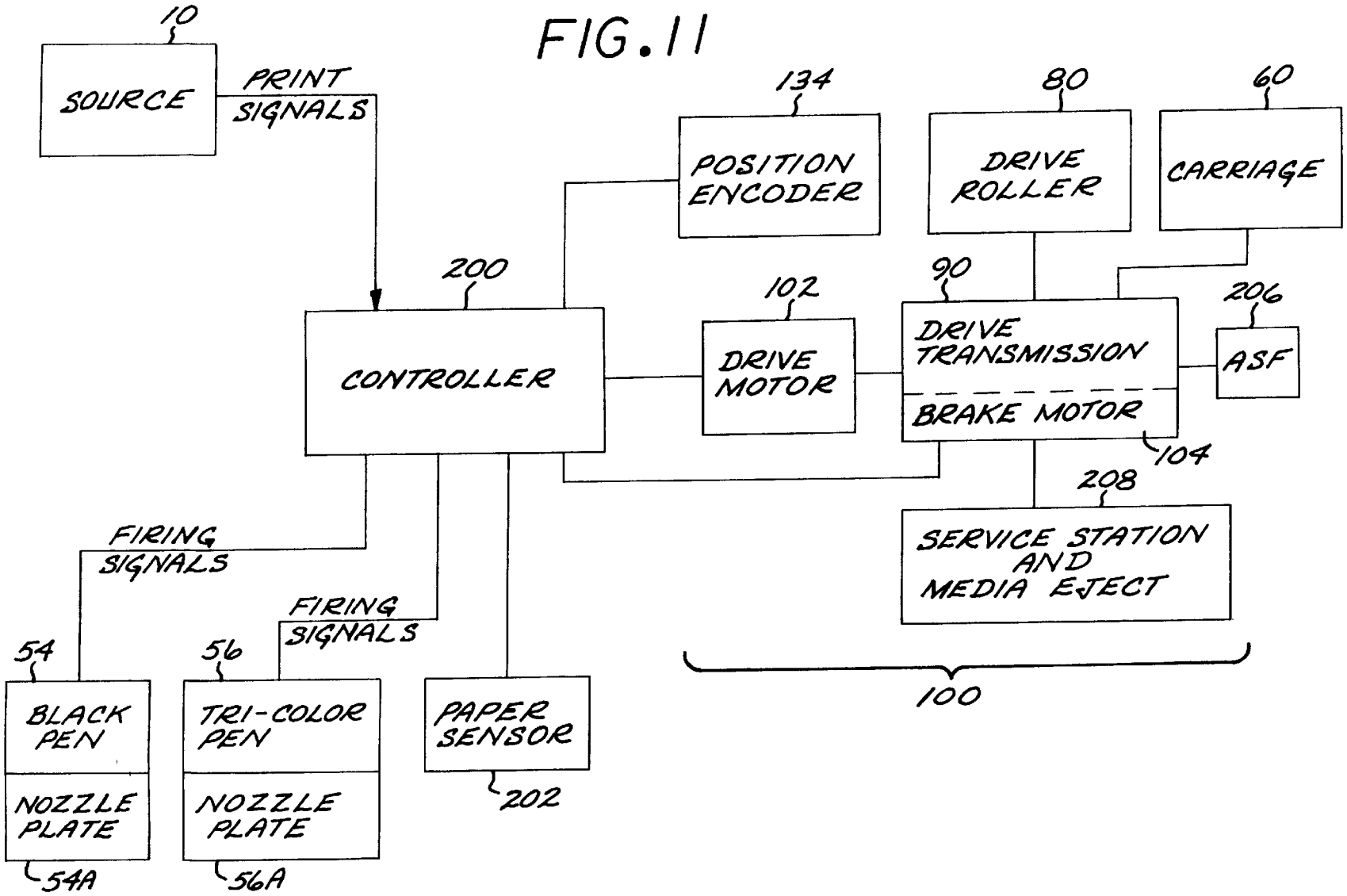
FIG. 11 is a simplified schematic block diagram of elements of the printer 50.

The print medium is driven in two axis by a media drive system 100 (schematically illustrated in FIG. 11). An exemplary low-cost apparatus suitable for the drive system employs two dc motors 102, 104, and only one feedback position encoder 134. One motor 102 and encoder assembly (132, 134) interfaces through a toothed pulley (116) to a continuous rubber timing belt (114). The second motor 104 activates a brake 110, the brake having the condition of being on or off. The belt 114 engages a motor encoder pulley 126, various idler pulleys 122, 132, and a drive pulley 120 fixed to a rotatable worm drive gear 130 mounted on the carriage 60. The worm drive gear engages a roller drive gear 140 mounted on the drive roller shaft 82, and powers the drive roller motion. The motorized brake 110 is employed to keep the worm gear 130 on the carriage from rotating during a carriage slew mode. The timing belt 114 is thereby fixed relative to the paper carriage in this mode, and driving the motor 102 causes the carriage 60 to translate. When swath advance is desired, the second motor 104 is used to release the brake 110 on the worm gear 130 and simultaneously brake the translation of the carriage. Motion of the drive motor then causes the worm gear on the carriage to rotate, thereby rotating the drive roller. This arrangement facilitates power transmission to both axes while allowing the carriage to cantilever off either side of the printer frame, and also eliminates the cost of one encoder.

Thus, in an exemplary embodiment, the drive system 100 includes the drive roller assembly 80, and further includes a dc drive motor 102, which is coupled to the roller 80 by a drive transmission 90 (FIG. 11). The drive system further includes an endless toothed drive belt 114 which is reeved about a pulley system including the drive pulley 116 mounted on the shaft 102A of the drive motor 102, idler pulley 126 and pulley 118, and pulleys 120, 122 (122 is visible in FIG. 4). The pulleys 116, 118 and 126 rotate on shafts which are stationary relative to the printer housing structure. The pulleys 120, 122 are carried on the carriage 60. The pulley 120 is fixed to one end of shaft 124. Also mounted on shaft 124 is a worm gear 130 (FIG. 4) for imparting rotational drive to the drive roller in one mode of operation (when, as described below, the brake link 108 has engaged the brake 110 to lock the position of the carriage 60 along its linear path of travel). The pulley 122 is mounted on shaft 122A for free rotation as an idler.

While in this exemplary embodiment, a toothed belt and toothed pulley 116 are employed, other arrangements could alternatively be employed to provide a non-slip drive.

A brake motor 104 drives a brake worm gear 106 which engages a brake gear rack 108A comprising a brake link 108. The brake link 108 is mounted for pivoting movement about pivot axis 112 (FIG. 4), and the brake motor 104 provides motive force to pivot the brake link about the axis 112 into and out of engagement with a brake 110 mounted on the media carriage 60. When the brake link is not in engagement with the brake, a brake spring 110A biases the position of the brake into engagement with the worm gear 130, so that the drive transmission is in the mode to translate the carriage linearly. When the brake motor is activated to rotate the brake link 108 into engagement with the brake 110, corresponding teeth 108B on the brake link engage a corresponding toothed pattern 110D on the brake, locking the linear position of the carriage along its slew axis. This engagement also causes the brake to rotate about its pivot point and out of engagement with the worm gear 130.

An encoder wheel 132 is mounted on pulley 126. An optical detector 134 monitors rotation of the wheel 132. Optical detectors and wheels suitable for the purpose are well known and commercially available. The encoder provides signals to a printer controller indicative of the movement of the belt, and hence the rotational movement of the drive motor. To minimize the effect of eccentricities in the encoder wheel 132 and the worm gear 130, the drive system is adapted so that the minimum movement of the worm gear is an integral multiple of 360 degrees, and the minimum movement results in a movement of the encoder wheel of some integral number times 360 degrees. In an exemplary embodiment, the worm gear 130 is moved in integral multiples of four complete rotations of the worm gear. Thus, the smallest permitted movement of the worm gear is four complete revolutions. This minimum movement of four revolutions of the worm gear is nominally accompanied by three complete revolutions of the encoder wheel 132. The gear ratio between the worm gear 130 and the main drive gear 140 on the drive roller shaft 82 is relatively high, e.g. 100:1 in this exemplary embodiment.

Figure 4:
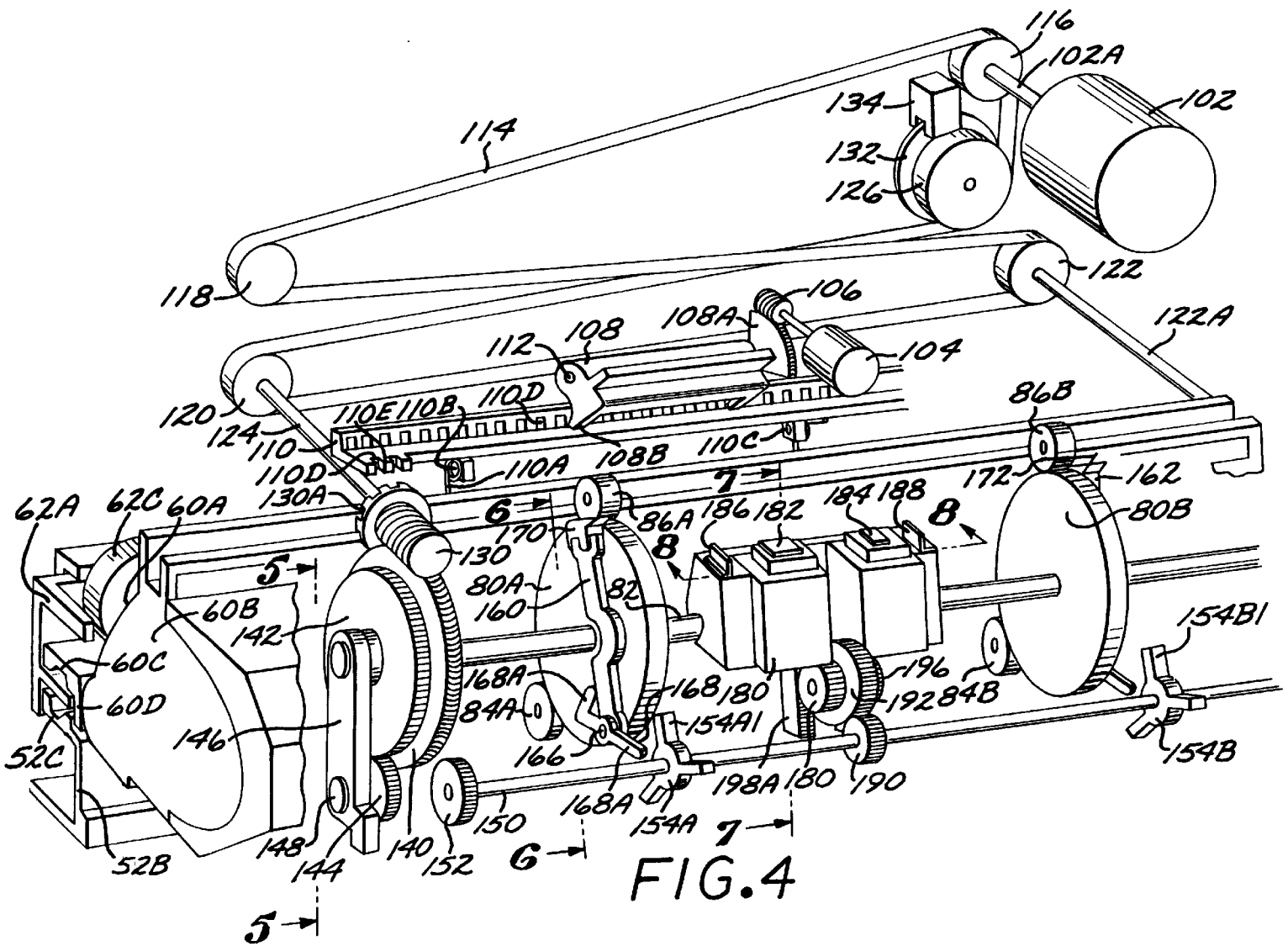
FIG. 4 is a diagrammatic isometric view of portions of the carriage, drive system, and elements carried on the carriage to perform sheet feeding, sheet ejection and pen service functions.

FIG. 4 is an isometric diagrammatic view illustrating the drive transmission and elements mounted on the carriage. FIG. 4 illustrates the belt 114 reeved about the pulley system. The brake 110 is mounted on the carriage shell housing 60A for pivotal movement on pivot pins 110B, 110C. The spring 110A biases the position of the brake 108 into the engaged position with the worm gear 130. Also shown in FIG. 4 is the roller drive gear 140 mounted on shaft 82 and has helical gear teeth adapted to engage the teeth of the worm gear 130, to translate motion of the worm gear into rotational motion of the shaft 82. The main drive gear is pressed onto the shaft 82, as are the hubs of the roller tires 80A, 80B.

A secondary drive gear 142 is also pressed onto the shaft 82 outboard of the main drive gear. A rocker arm 146 is mounted on the shaft 82 outboard of the gear 142 with a friction fit, allowing slippage of the arm on the shaft when resistance to further rotation is found. The rocker arm 146 carries a rocker gear 144 mounted on shaft 148 which engages the secondary drive gear 142. Alternatively, the secondary drive gear 142 could be omitted, and the rocker gear 144 fabricated with helical teeth to engage the teeth of the roller drive gear 140.

Figure 5:
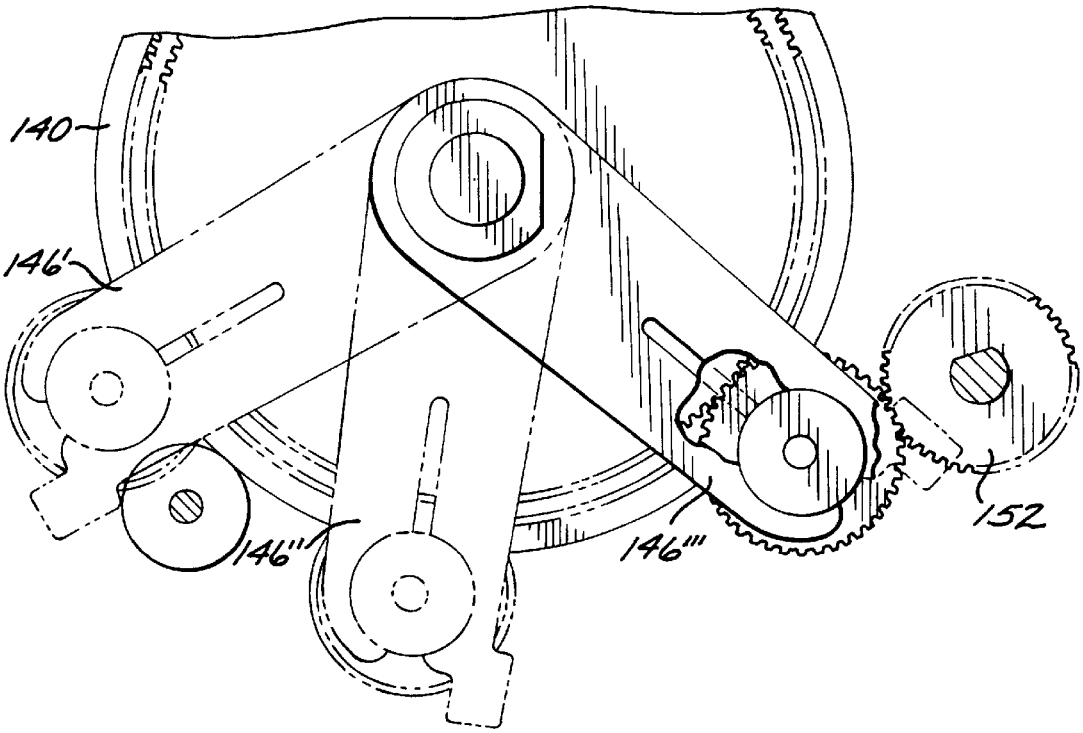
FIG. 5 is a side view of the main roller drive gear and rocker arm, taken at line 5—5 of FIG. 4, showing the rocker arm in three different positions.

The rocker arm 146 has three working positions, which are illustrated in FIG. 5. The first position, represented by 146', is one of repose during printing operations. In this case, the roller 80 has been driven clockwise (as viewed from the orientation illustrated in FIG. 6) to position the paper leading edge at the print zone, and this rotates the rocker arm clockwise to a position in which the rocker gear does not engage another gear. The rocker arm typically remains in this position until the printing is completed on the sheet of paper.

Figure 6:
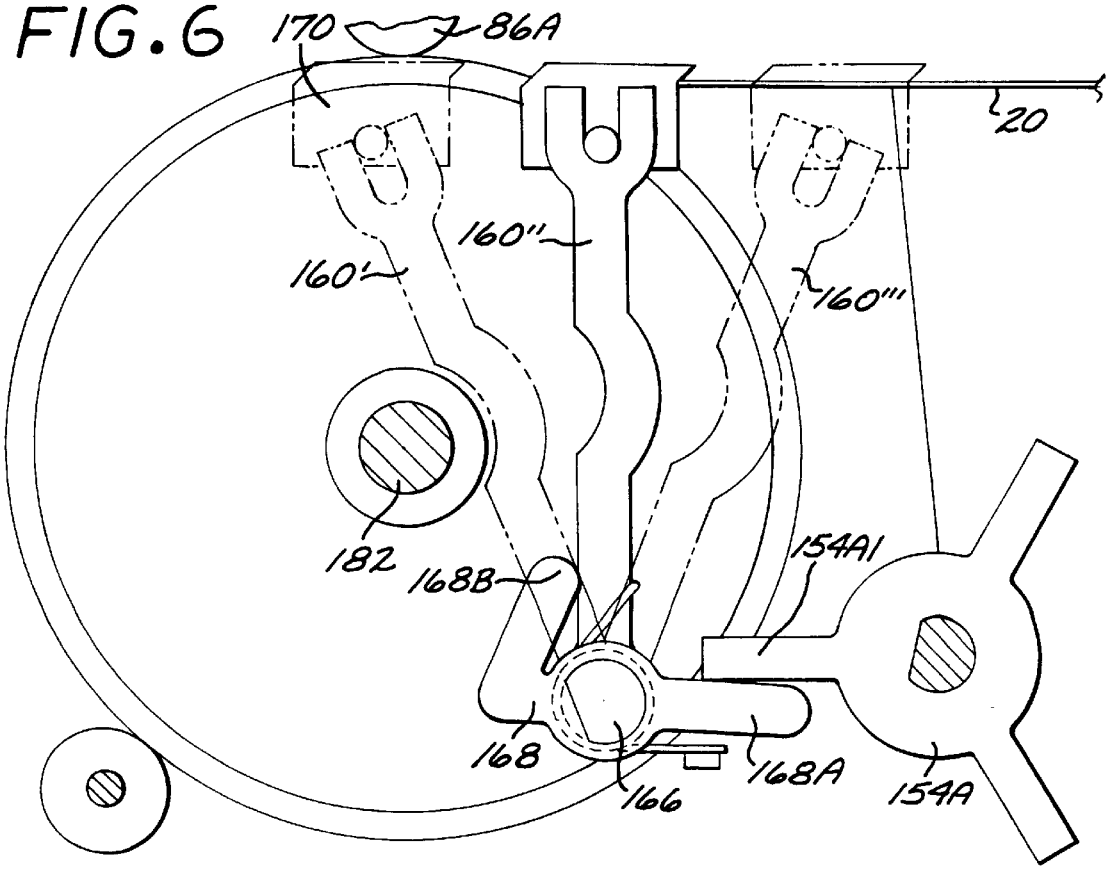
FIG. 6 is a partial side cross-sectional view taken along line 6—6 of FIG. 4, showing the kicker fork in three different positions.

Another position of the rocker arm is that illustrated in FIG. 6 as 146", and is the position in which the rocker gear engages an automatic sheet feed (ASF) gear 220 (FIG. 2). The ASF gear 220 is positioned at the paper input tray 74, and is connected to a pressure plate 222 (FIG. 2) which pivots about a pivot 224. The ASF gear has a cam surface 220A which lifts the pressure plate when the gear is positioned for ASF operation. The drive roller 80 is driven in the reverse direction to rotate the rocker arm counterclockwise past the location at which the ASF gear will be engaged. The drive transmission is then shifted into the carriage slew mode, to position the carriage over the input paper tray, i.e. at the center of its range of movement. Now the brake motor will be activated to bring the brake link into engagement with the brake, locking the position of the carriage and lifting the brake out of engagement with the worm gear 130. The drive motor 102 is activated to rotate the drive shaft 82 in the clockwise direction. The rocker arm will follow the movement of the shaft 82 until the rocker gear is brought into engagement with the ASF gear. Further rotation of the shaft 82 results in drive of the ASF gear, which will lift the pressure plate, bringing the leading edge of the top sheet in the input tray in contact with the drive roller tire surfaces. With the drive roller rotated in the direction of swath advancement, the top sheet is picked, carried into the nip between the drive roller tires and the idler rollers, and advanced until the leading edge is proper position relative to the print zone for printing to begin.

FIG. 2 is only a schematic illustration, and the ASF gear 220 can actually be connected to the pressure plate through a cam link (not shown) which in turn actuates the pressure plate. The ASF gear 220 in an exemplary embodiment is fabricated as a wide spur gear, wherein one half of the thickness of the gear is formed with teeth around the entire gear periphery, and the other, inside half of the ASF gear has teeth only on a portion of the circumference of the gear. During ASF operation, the carriage can be moved laterally from an initial position wherein the rocker gear engages the outside half of the ASF gear to rotate the ASF gear through a full cycle of the gear. Once the leading edge of the print medium is picked and moved into the nip between the drive roller and the idler rollers 84A, 84B, there is no longer a need to lift the pressure plate. By moving the carriage slightly laterally, the rocker gear now engages only the inner half of the ASF gear, wherein rotation of the rocker gear will no longer result in rotation of the ASF gear, once the portion of the ASF gear is reached that has no teeth. The toothless portion is positioned relative to the ASF cam so that the pressure plate is in the lower position once this toothless portion is reached. This provides a means of ensuring that the pressure plate is lowered once the top sheet has been picked, and remains lowered during printing operations.

Another position of the rocker arm 136 is that shown as 146"' in FIG. 6, wherein the rocker gear is brought into engagement with the activation gear 152, discussed more fully below.

As further illustrated in FIG. 4, mounted outboard of the drive roller tires 80A, 80B are respective kicker activation forks 160, 162. These forks are similar in structure and function, and accordingly exemplary fork 160 will be described. One end of the fork is pivotally mounted on a pivot pin 166, which is fixed to the carriage housing. The position of the fork on the pivot pin is biased by a torsion spring 167 (FIG. 6). Also mounted on the pin 166 is a kicker activation lever 168. The distal ends of the forks hold a respective kicker tooth element 170, 172 which actually contacts the trailing edge of the paper sheet during the kicker movement to impart an ejecting force to the sheet, ejecting the paper from the carriage onto the output location.

Also mounted within the carriage 60 is an activation shaft 150, which runs parallel to the roller shaft 82. The shaft is conventionally mounted on bearings within the housing 60A for rotation. Several elements are press fitted onto the activation shaft 150. An activation gear 152 is mounted for engagement by the rocker gear 144 when the rocker arm 146 is rotated counterclockwise relative to its position shown in FIG. 4. When engaged by the rocker gear, the activation shaft can be driven counterclockwise as the shaft 82 is driven counterclockwise.

The activation shaft carries two kicker activation wheels 154A, 154B, each of which drives a respective one of the kicker activation forks 160, 162 which eject the paper from the drive roller when printing is completed. The respective wheels 154A, 154B each include three protruding tabs 154A1, 154B1. The tabs contact the adjacent ends of the kicker activation levers to cause rotation of the kicker activation forks about the pivot pin, bringing the kicker tooth elements into contact with the trailing edge of the paper sheet and ejecting the sheet. Thus, for example, end 168A of lever 168 is contacted by tab 154A1, causing rotating of lever 168 about pin 166. This rotation in turn brings lever end 168B into contact with the fork 160, causing the fork 160 to also rotate against the spring bias in a clockwise direction relative to the configuration of FIG. 6, with successive positions of the fork 160 indicated in FIG. 6 as 160', 160" and 160"'. The movement of the forks kicks the sheet 20 out of the carriage. As the activation shaft continues to rotate counterclockwise, the tab passes out of contact with the lever 168, and the kicker fork returns to the non-active position shown in FIG. 4, where the tooth 170 is recessed from the paper path and cannot contact the print media.

Figure 7:
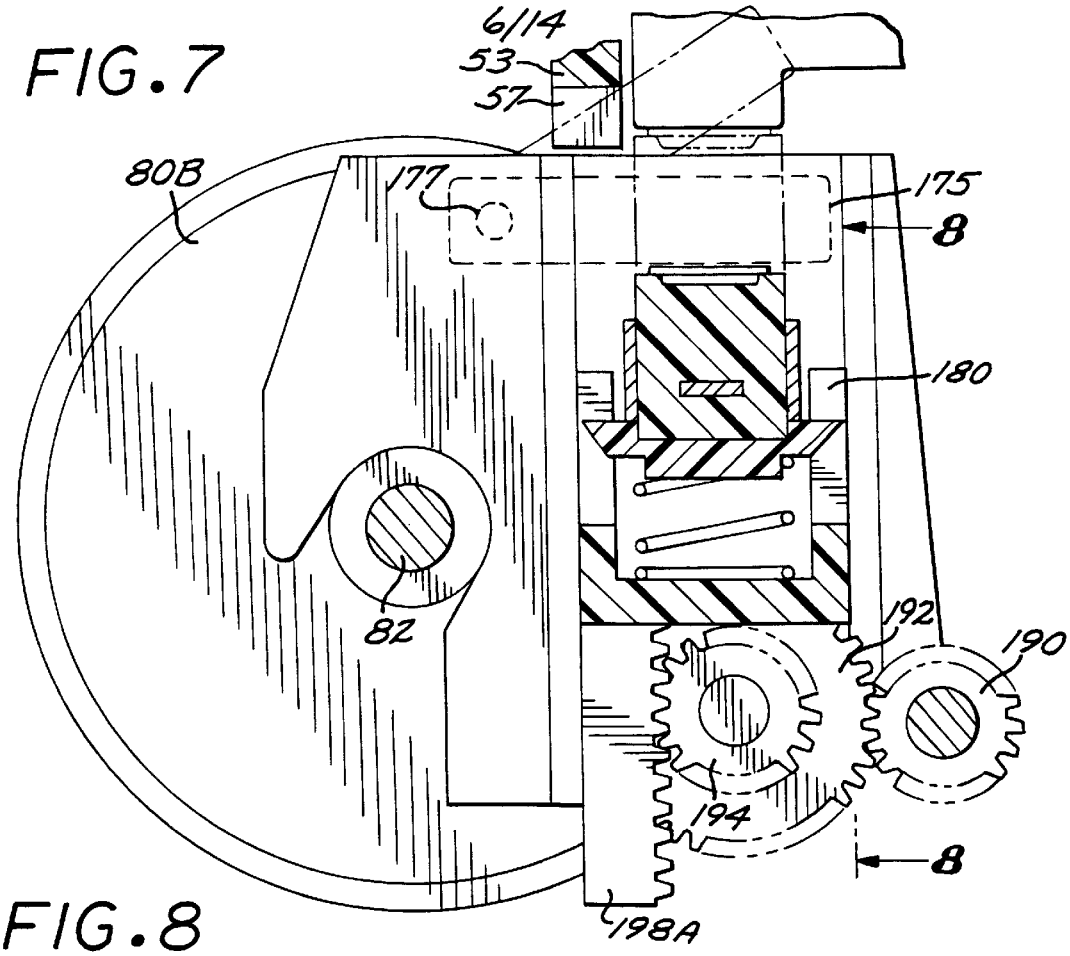
FIG. 7 is a partial side cross-sectional view taken through line 7—7 of FIG. 4.
Figure 8:
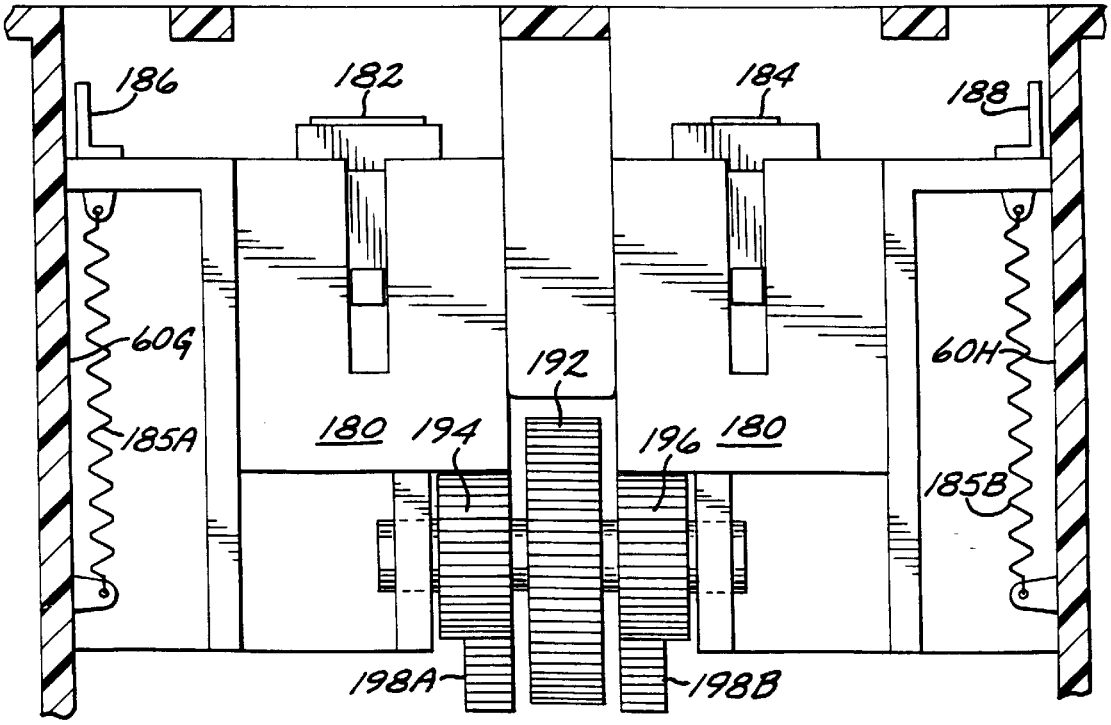
FIG. 8 is a cross-sectional view taken through line 808 of FIG. 7, illustrating the service station gear drive.

The activation shaft 150 also drives the service station, raising a sled 180 which carries the caps 182, 184 and wipers 186, 188 used in respective capping and wiping functions. (See also FIGS. 7 and 8) The activation shaft 150 has mounted thereon a sled activation gear 190. The sled includes a sled gear rack assembly 198 which is engaged by idler gears 194, 196, which are driven by gear 192. The gear 192 engages the sled activation gear 190. Thus, drive force is supplied through the sled activation gear train comprising gears 190–198 and rack assembly 198, to lift the sled upwardly along a path determined by guiding surfaces 60D, 60E of the carriage housing 60A. Thus the sled is constrained to move along a channel defined by the guiding surfaces, and its position is biased to the lowered position by spring members schematically illustrated in FIG. 8 as elements 185A, 185B. When the rocker gear is disengaged from the activation gear 152, the sled will return to the lowered position shown in FIG. 7.

In this exemplary embodiment, the printer has two pens 54, 56, each with its own nozzle plate 54A, 56A. The pens are different, with one being a single color pen using black ink, and the other a three color pen, with three colors, typically cyan, yellow and magenta. Thus, the respective nozzle arrays on each nozzle plate are different, and so the nozzle caps 182, 184 carried on the sled 180 are also different. (FIG. 9) The sled 180 carries two caps which are spaced apart by the same distance as the pen nozzles of the two pens are spaced, so that by lifting the sled upwardly during a capping function, the caps are properly positioned to cap the nozzle plates. The sled also carries two wiper blades 186, 188, one each outboard of the caps. The wipers are positioned at a higher elevation than the caps on the sled, so that a partially raised sled 180 during a wiping function will position the wipers to contact the nozzle plates of the pens as the carriage is translated. The carriage 60 can be moved back and forth along its axis in a series of movements to wipe the nozzle plates to remove accumulated dried ink, dust and other debris.

Another function performed when the sled is raised to the capping position is to lock the lateral position of the carriage. This is done by a lever 175 shown in phantom in FIG. 7, which rotates about a pivot 177 fixed on the carriage housing. When the sled is raised to the capping position, the sled structure contacts the lever, rotating it upwardly about the pivot, so that the lever extends above the carriage platen surface, and the tip of the lever is received in a corresponding recess 57 formed in the pen holder structure 53. With the sled in the capping position, the carriage is locked from lateral movement. Raising the sled partially to the wiping position does not expose the lever above the platen surface, so that the lever does not interfere with the wiping function.

The use of two relatively narrow roller tires 80A, 80B provides an open cylindrical envelope space between the tires. This provides the advantage over a solid roller structure of space to place functions such as the service station function in this exemplary embodiment. As described below, the printer service station is supported by the carriage housing in the envelope space. Of course, in an alternate embodiment, the service station can be placed adjacent an end of the carriage, and a solid roller used instead of the two roller tires. This has the disadvantage of requiring somewhat longer carriage length than if the service station is supported between the relatively narrow roller elements 80A, 80B. The service station could also be positioned in front of the drive roller on the carriage, e.g. with a reduction in the roller diameter.

It is not necessary that the wiper blades be mounted on a movable service station sled. In an alternate embodiment, the wiper blades can be mounted at the ends of the carriage in a fixed, protruding position relative to the platen surface, outside of the normal travel of the carriage during normal printing operations. The nozzle plates can then be wiped by moving the carriage toward the end of travel in a given direction, bringing the wiper blade in wiping contact across the nozzle plate. For example, the wiper blade could be fixed to the carriage outside the spittoons on the platen surface, so that debris collected from the nozzle plate is deposited in the spittoon. For the case of a two pen system, the wiper blades for the respective pens can be located at opposite ends of the carriage. This alternate arrangement eliminates the need for mounting the wiper blades on a movable sled structure, and can readily permit wiping during a printing cycle on a medium. This is provided at the end of a swath by simply continuing the carriage movement enough to pass the wiper past the immobile pen nozzle plate.

Figures 9, 10A, 10B:
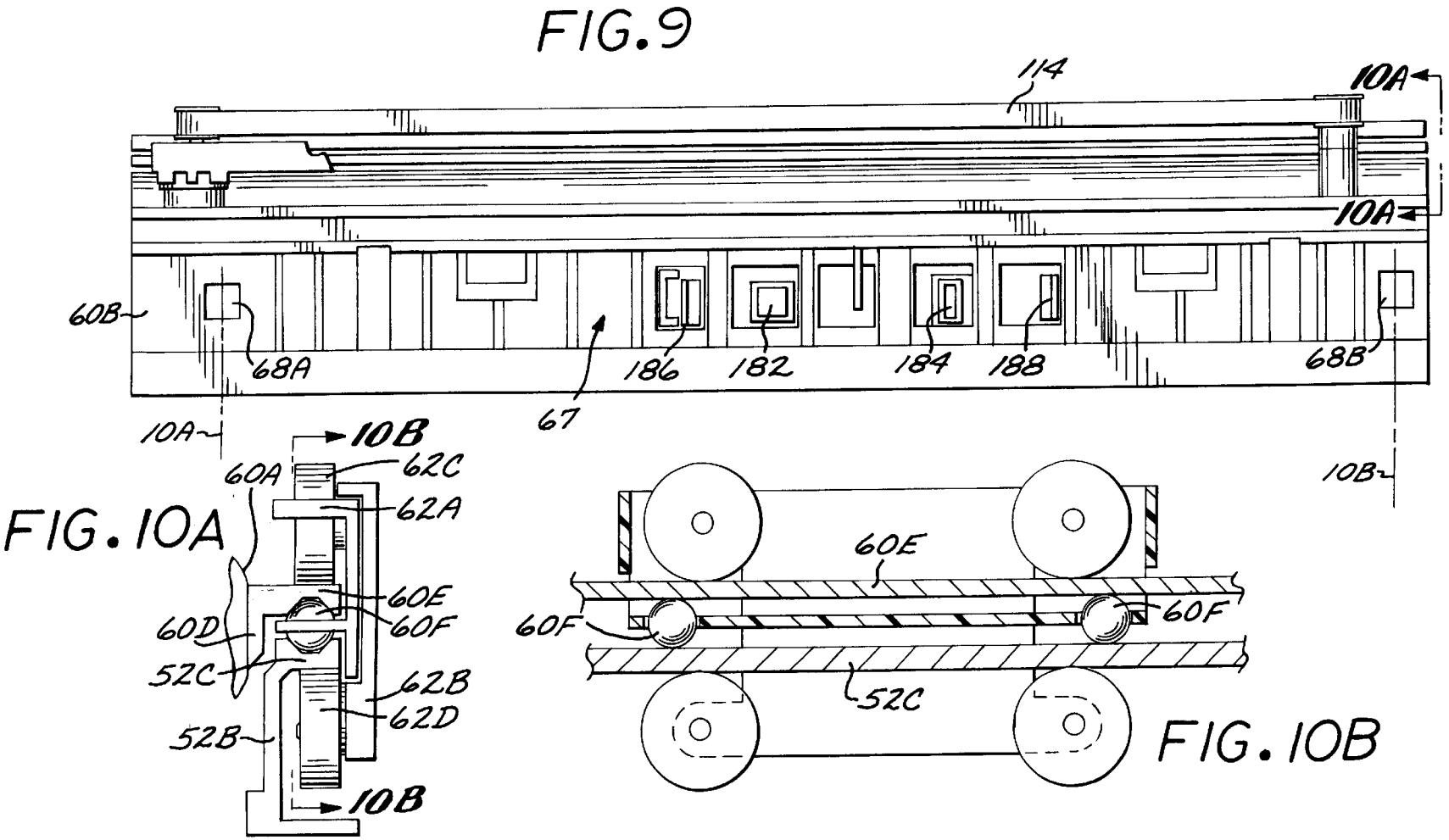
FIG. 9 is a top plan view of the carriage, showing the capping surfaces and wiper elements.
FIG. 10A is a side view taken at 10A—10A in FIG. 9, showing the linear bushing supporting the carriage.

The carriage 60 also carries a pair of spittoons 68A, 68B at the left and right ends which are positioned on the top platen surface 67 to underlay the left and right edges of the print medium during printing. This is illustrated in FIG. 9, where dotted lines 10A and 10B represent the left and right marginal edges of a print medium sheet during printing. The spittoons are receptacles having disposed therein an ink-absorbing pad. Significant areas of the spittoons remain exposed at the sides of the sheet, and therefore support marginless printing operations, wherein the printer supports printing to the edges of the sheet, with the spittoons receiving any overspray ink droplets which would otherwise land on the platen surface 67. The spittoons are also used in a pen spitting operation to clear blocked nozzles, where a pen is positioned over the spittoon and the nozzles fired. Borderless printing is described in commonly assigned, copending application 09/175,818, filed Oct. 20, 1998, David Meyer, METHOD AND APPARATUS FOR PRINTING BORDERLESS PRINT IMAGE.

FIG. 11 is a schematic block diagram of elements of the printer 50. The printer includes a controller 200 which receives print signals from a source 10, which may be a personal computer or digital camera, or other source of print data. The controller issues firing pulses to control the firing of the pens 54, 56 during print operations. The controller also receives sensor signals from a paper sensor 202 which is positioned to detect whether a print medium is present at the print area. The sensor 202 optically senses the presence or absence of a mechanical flag on the carriage, which is displaced by the print medium when present. The controller also receives position data from the encoder 134, and issues control/drive signals to the drive motor 102 and the brake motor 104 comprising the transmission 90. The drive transmission provides drive to the drive roller 80, the ASF function 206, and the service station and media eject functions indicated generally as 208 in FIG. 11, all as heretofore described.

In operation, a print signal is provided from a source 10 such as a personal computer, digital camera, or other source of printing signals. The paper carriage 60 is positioned over the paper input tray. The drive roller rotates forward while simultaneously lifting the paper stack via the ASF function. The top sheet is picked and wraps around the roller, with the leading edge extending under the inkjet pen nozzles. The pens fire ink drops as the paper carriage translates the paper under the pens, the drive roller rotation remaining fixed for the duration of the printing. At the end of travel, the drive roller advances forward and stops, ready for the next print swath. Printing can occur similarly, in the reverse direction as the paper carriage translates back in the start position. This pattern continues until the page has been fully printed. The carriage is then positioned at the desired paper drop location. The drive roller rotates in the opposite direction as is used for paper advancement, actuating the kicker mechanism and ejecting the paper into an output tray or location.

The controller 200 is adapted to shift the drive transmission 90 from one operating mode to the other, i.e. between the carriage drive mode and the roller drive mode. These operations are performed by use of the brake motor 104 and the drive motor 102. To connect the roller drive, which will occur when the carriage drive is already connected, the carriage 60 is first moved to one of the transmission switch positions determined by the respective notches 110D formed on the brake 110 and at least one of the two teeth 108B formed on the brake link 108. The encoder coordinates of the various switch positions is known to the controller 200 as a result of prestored switch position data, and represent positions at which the teeth 108B intermate with corresponding notches 110D to allow locking of the carriage and unlocking of the worm gear 130. Since the brake is formed with notches along its length, there are many possible switch positions.

With the carriage positioned at a switch position, the drive motor 102 can be switched from the mode of moving the carriage to the mode of moving the roller 80. This is done by applying a voltage of a given polarity to the brake motor 104 for a given length of time sufficient to move the brake link 108 to disengage the brake 110 from the worm gear 130 (allowing the worm gear to rotate) and move the brake link teeth 108B into a notch fix with notches 110D of the brake. The notches formed on the brake 110 have some gap to allow for tolerances and lack of precision of the servo formed by the motor 102, the encoder 134 and the controller 200. Now the motor 102 is driven to turn the encoder wheel 132 three complete rotations, causing the worm gear 130 to rotate four complete rotations. The encoder 132 is not on the worm gear 130, but is fixed in relation to the printer chassis, with the worm gear traveling with the carriage as described above. The worm gear and encoder wheel are connected by the pulley and belt system, with a gear ratio of 4:3. Since there is a gap on the tooth-engaged notch 110D of the brake, the carriage 60 will move towards one side of the notch. This position of this side of the notch has been measured previously, and the difference between the notch position and the carriage position is added to the three turns of encoder rotation, so that the worm gear teeth 130A will align with the brake teeth 110E after the four turns. After some function is performed by turning the roller/activation shaft, the position of the worm is precisely known in relation to the encoder by simply keeping track of encoder rotations during the functions and prior to re-engaging the carriage drive. However, the precision is typically only needed during print operations to maintain print quality, and is less important during other functions such as service functions.

To disconnect the roller drive, drive voltage (of the opposite polarity) is applied to the brake motor 104 for a predetermined time interval, with the worm gear teeth 130A aligned with the brake teeth 110E, to disengage the brake link 108 from the brake 110, and engage the brake teeth 110E with the worm gear teeth 130A. This releases the carriage while locking the drive on the roller 80. Thus, the paper will not move while the ink is laid on it during printing.

The backlashes between the worm gear 130, the drive gear 140, the brake teeth and worm gear notches are controlled for accurate operation. The worm gear 130/drive gear 140 interface works in such a way that the same side of a tooth is in contact with the same side of the mating gear.

This is because, during printing operations, the paper is always driven forward. In this way, the backlash does not affect print quality. When the carriage is driven back and forth during printing operations, the belt 114 is pulling on the worm gear 130 in both directions. The worm gear rotates only the amount that the brake tooth and worm notch interface backlash allows. This backlash is less than the worm gear to drive gear interface backlash. Thus, movement of the worm gear 130 due to the backlash of the brake tooth to worm gear interface will not result in rotation of the drive gear.

Figure 12:
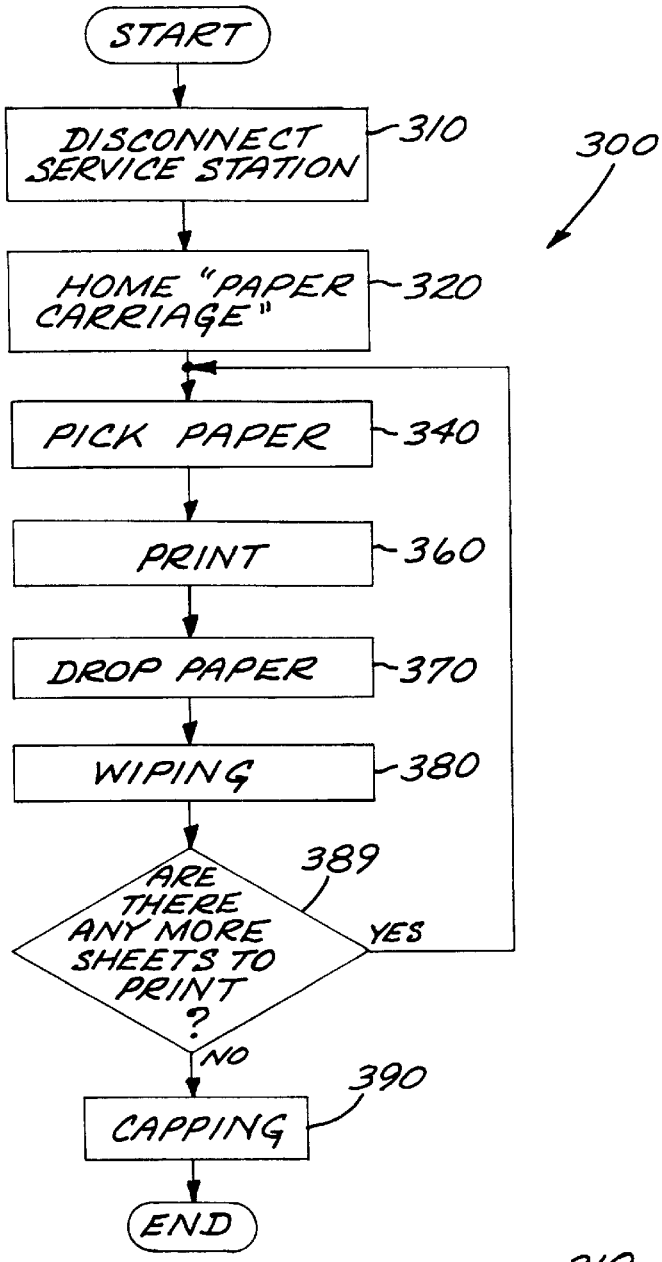
FIGS. 12–20 are simplified operational flow diagrams illustrating the operation of the printer.

FIGS. 12–20 are simplified flow diagrams illustrative of the operation of the printer 50. FIG. 12 is a top level diagram, showing general functions performed by the printer. Thus, at the start of operation, the "disconnect service station" routine 310 is performed, to disconnect the service station so that the sled is lowered to the printing position, uncapping the nozzle plates of the pens. Next, the "home paper carriage" routine 320 is performed, to ensure the proper start conditions for printing. The "pick paper" routine 340 picks the top sheet from the input stack, and transports the picked sheet through the paper path so that the leading edge is at the print area. Following the print routine 360, the paper is ejected using the "drop paper" routine 370. If desired, wiping can be performed on the printheads using the wiping routine 380. If more sheets are to be printed, operation branches back to the "pick paper" routine 340 to repeat the cycle. If no further pages are to be printed for the print job, the capping routine 390 is called, and operation is complete.

Figure 13:
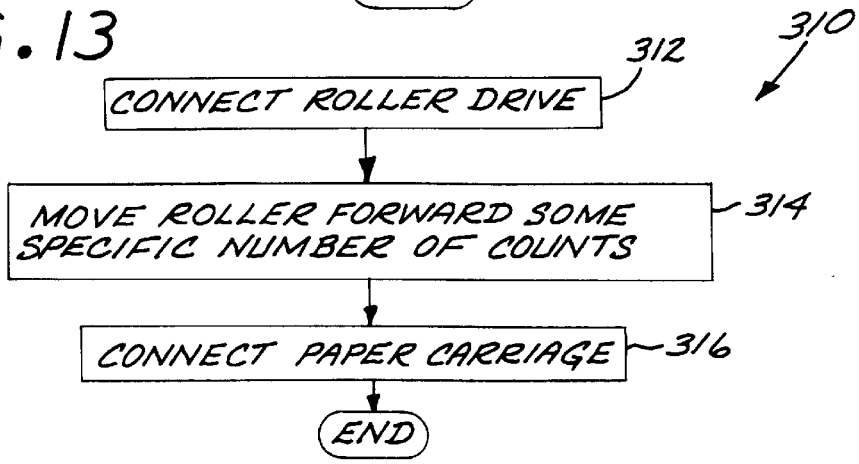

FIGS. 13–19 illustrate in further detail particular routines executed by the controller during aspects of printer operation outlined in FIG. 12. FIG. 13 illustrates the "disconnect service station" routine 310 in further detail. At step 312, the paper drive is connected, by releasing the brake 110 from the worm gear 130 while locking the position of the carriage. The drive motor 102 is activated to drive in the roller forward direction by some predetermined number of encoder counts, at 314. The carriage drive is then connected at 316, by activating the brake motor 104 to lock the brake 110 on the worm gear 130, while releasing the brake link from the brake. This completes the routine.

Figure 14:
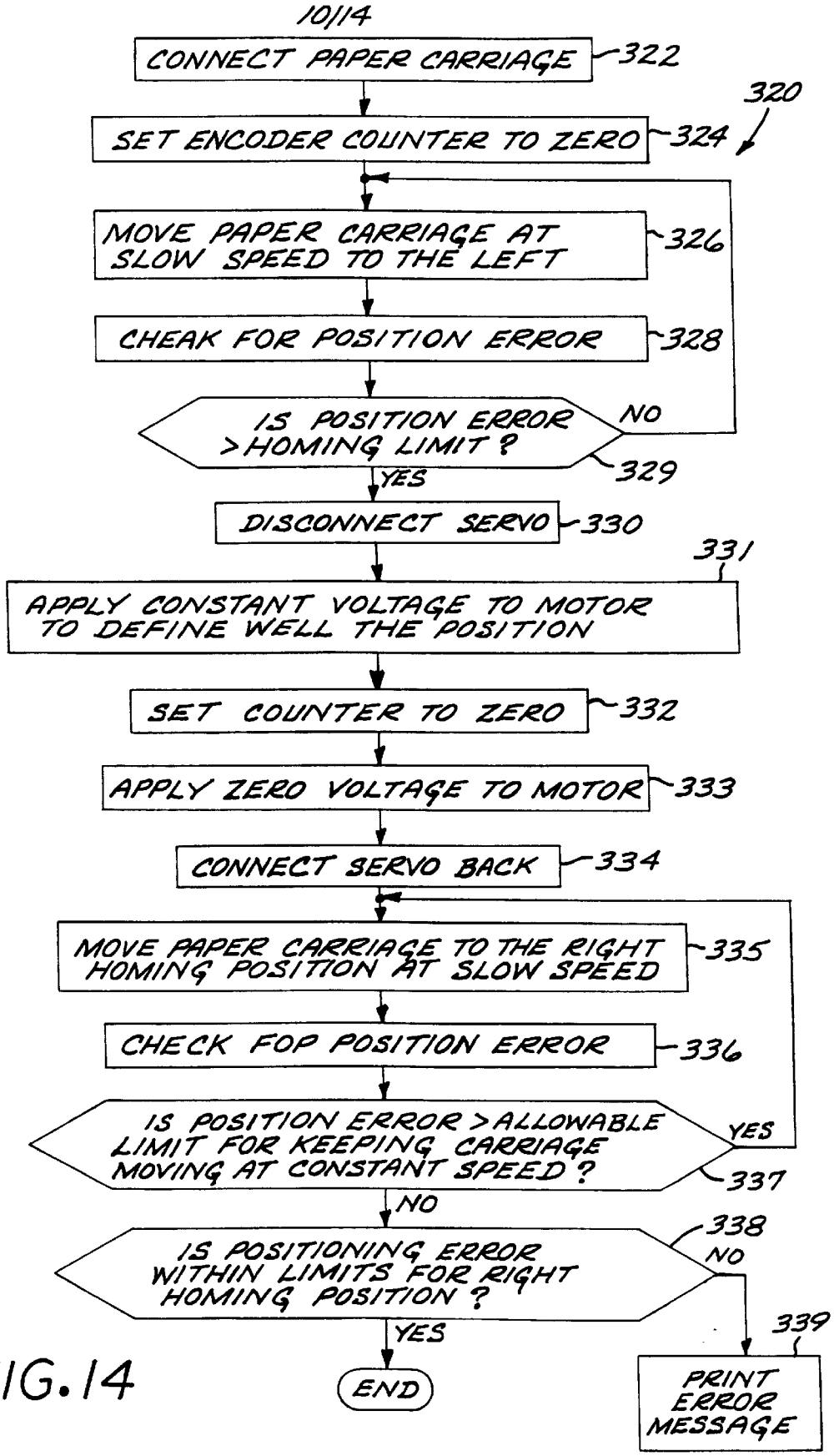

The "home paper carriage" routine 320 is illustrated in FIG. 14. This function is to locate the left and right homing positions of the carriage. At 322, the paper carriage drive is connected using the brake motor. The encoder counter (implemented by the controller 200) is set to zero at 324. The drive motor 102 is actuated to move the carriage at slow speed to the left, at 326. Using elapsed time and the encoder count, a check is performed for a position error at 328. The encoder count is assumed to represent the position, and so the expected position as a function of time is compared to the actual encoder count at a given time. At 329, if the position error is greater than a homing limit value, the system assumes that the left stop structure has been reached, preventing further movement of the carriage to the left, and operation proceeds to 330 to disconnect the servo, i.e. to remove the voltage from the drive motor 102. Otherwise, operation branches back to step 326 to continue moving left at slow speed. At step 331, a constant voltage is applied to the motor to define well the home position, the counter is set to zero (332), and zero voltage is applied to the drive motor at 333. Now the servo is reconnected (334), and the carriage is moved to the right homing position at slow speed (335). The position error is checked (336), and is tested against an allowable limit for keeping the carriage moving at a constant speed (337). Once the position error exceeds this allowable limit, another test is performed, to see whether the position error is within a limit for the right homing position (338). If not, an error message is generated. If yes, the routine is ended.

Figure 15:
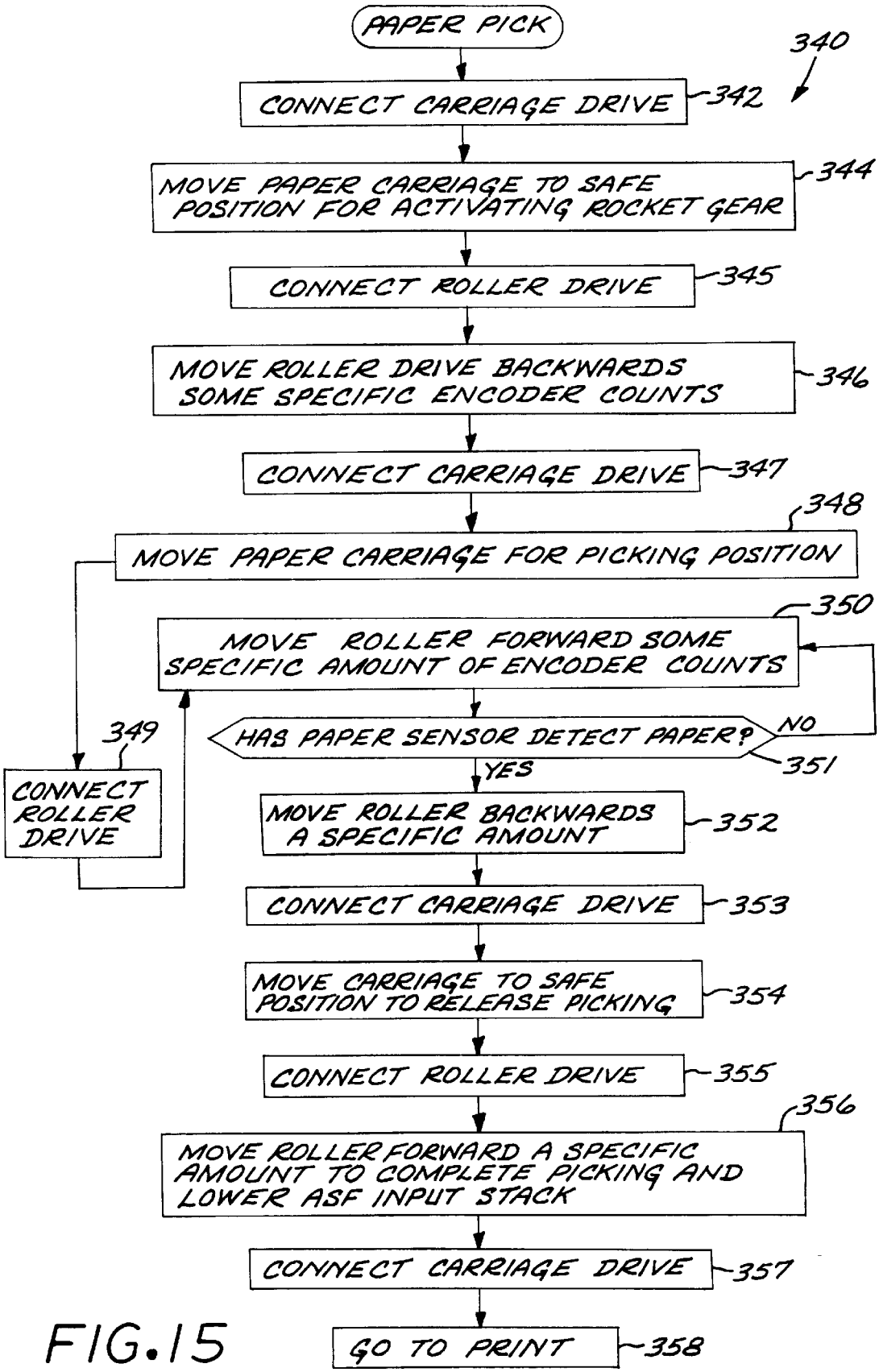

FIG. 15 illustrates the paper pick routine 340. At 342, the carriage drive is connected. The carriage is driven to a safe position for activating the rocker gear (344). Now the paper drive is connected (345), and the roller 80 is driven backwards, i.e. opposite the direction for paper swath advancement, by a predetermined number of encoder counts (346). The carriage drive is again connected, at 347, and the carriage is moved to the picking location, i.e. the location of the input tray (348). The paper drive is connected (349), and the roller is driven forward by a predetermined number of encoder counts (350), which will cause drive on the ASF gear, lifting the pressure plate and bringing the top sheet into contact with the drive roller. At 351, the paper sensor 202 is checked, and if paper has not been detected, operation loops back to 350 to continue moving the paper forward. If paper has been detected at 351, then at 352, the roller 80 is driven backward a predetermined amount to correctly position the paper for commencement of printing. The carriage drive is connected (353), and the carriage is moved to a safe position to release the picking (354), i.e to position the rocker gear on the inside half of the ASF gear which has only a partial teeth set as described above. The roller drive is connected at 355, and the roller 80 is rotated forward a predetermined number of encoder counts to complete the picking and lower the ASF pressure plate (356). The carriage drive is connected (357), and operation proceeds (358) to the print routine 360.

Figure 16:
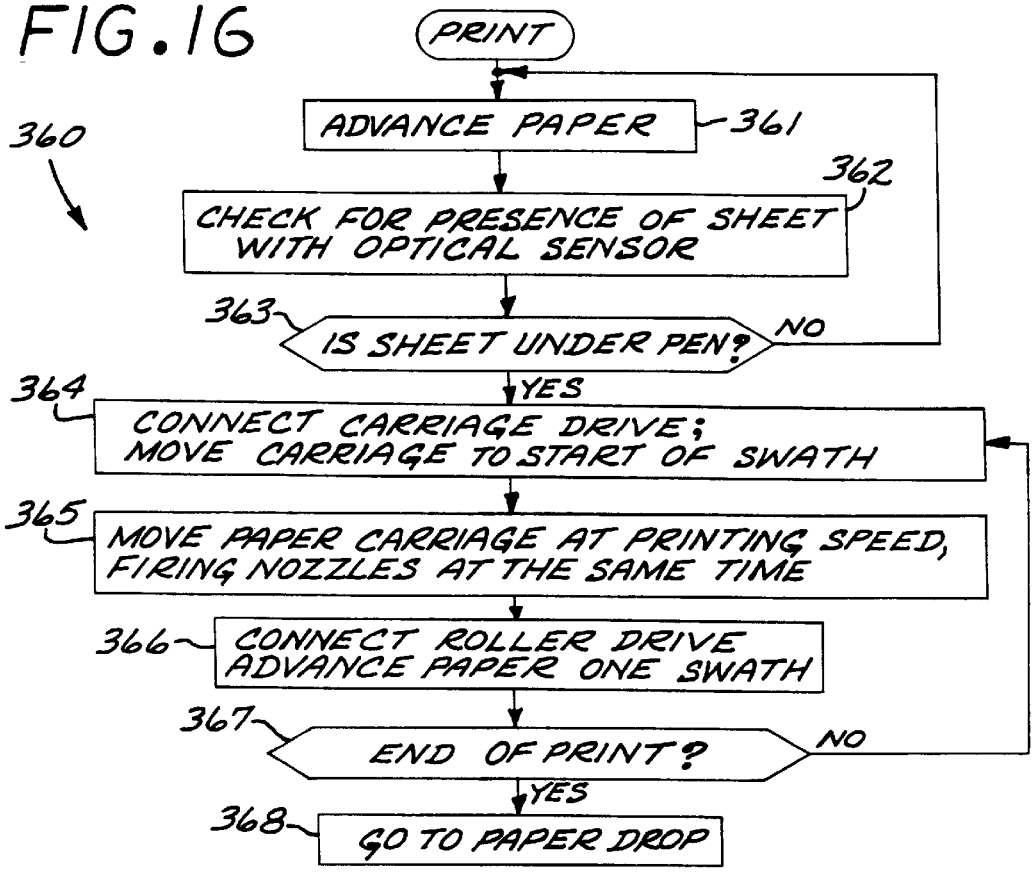

The print routine 360 is shown in further detail in FIG. 16. At step 361, the paper is advanced, until the paper sensor indicates that the paper sheet is under the pens (362, 363). Now the carriage drive is connected, and the carriage moved to the start of swath position (364). The carriage is then moved at printing speed, while firing the pen nozzles (365). The roller drive is then engaged, and the paper is advanced one swath (366). Operation branches back to 364 to print another swath, unless the end of the print has been reached, when operation will branch (368) to the paper drop routine (370).

Figure 17:
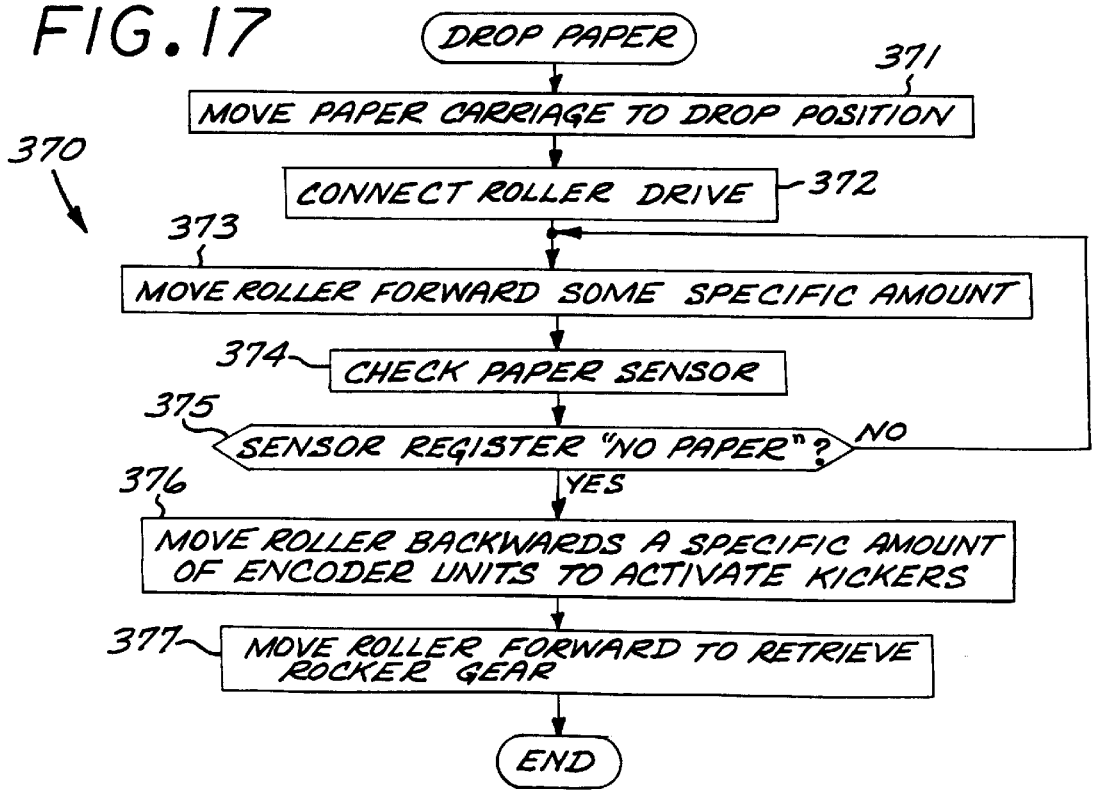

The drop paper routine is shown in FIG. 17. At step 371, the carriage is moved to the paper drop position. The roller drive is then connected (372), and the paper advanced by a predetermined amount (373), the sensor 202 checked (374) to determined whether the sensor registers "no paper" (375), i.e. that the trailing edge of the paper has advanced past the sensor flag. The roller is advanced until the sensor registers no paper is present. Then the roller 80 is rotated backward by a predetermined number of encoder counts to activate the kicker forks, ejecting the paper from the carriage onto the drop location (376). The roller 80 is then rotated forward by a predetermined number of encoder counts to retrieve the rocker gear (377). In an alternate arrangement, steps 374 and 375 are omitted, so that no sensor is involved. The step 373 moves the paper by a sufficient amount that the trailing edge has exited the nip between the drive roller 80 and the pinch rollers 86A, 86B. Then the roller direction is reversed to activate the kicker forks to eject the paper.

Figure 18:
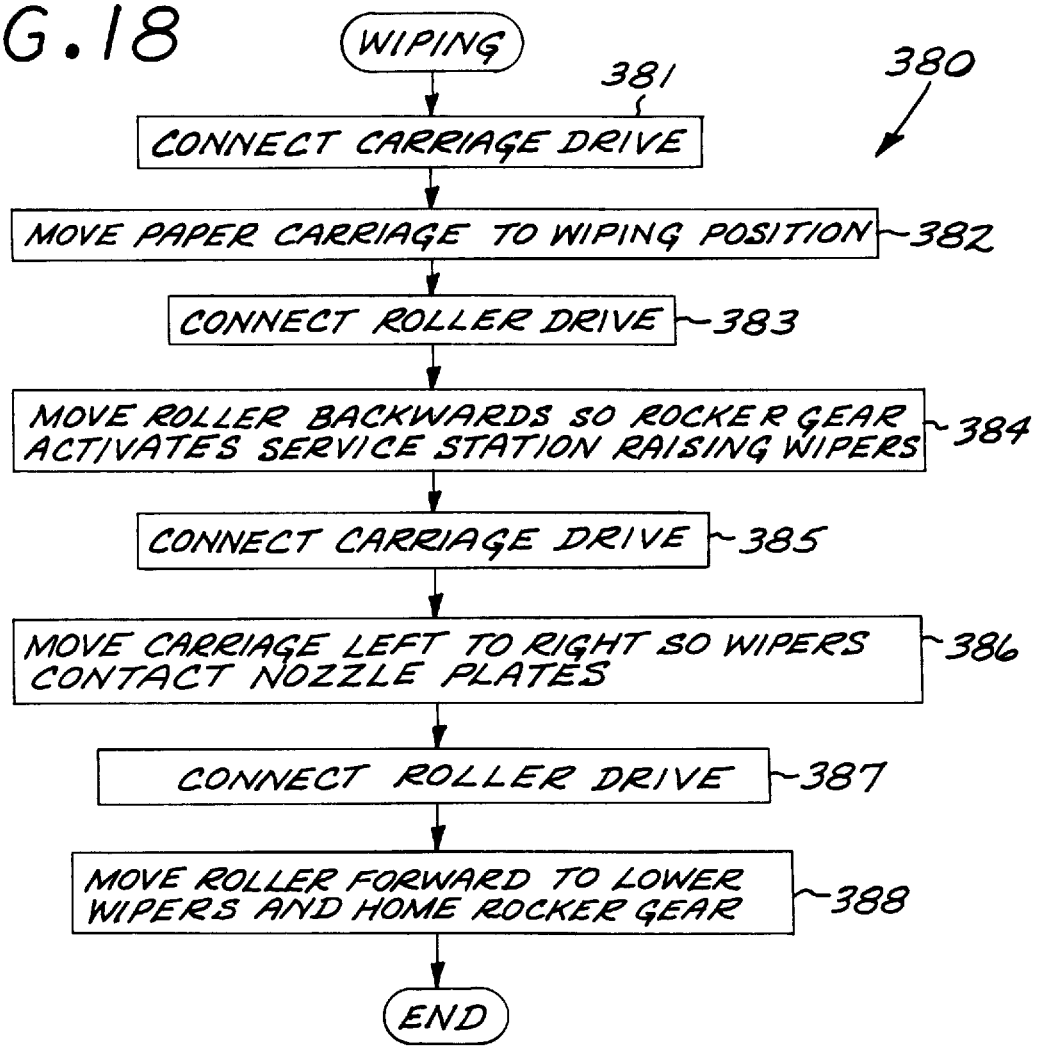

FIG. 18 shows the wiping routine 380, which can be performed on a schedule as determined by the controller 200. It may not be necessary in some application to perform wiping of the nozzle plates after printing each page. At 381, the carriage drive is connected, and the carriage is moved to the wiping position, positioning the wipers to one side of the pen nozzle plates (382). The roller drive is then connected (383), and the roller is moved backward a predetermined number of encoder counts, so that the rocker gear activates the service station, raising to the partially raised position to expose the wipers without fully lifting the caps to their fully raised position (384). The carriage drive is then connected (385), and the carriage is moved left to right so that the wipers contact and wipe across the nozzle plates of the pens (386). The carriage drive is then disconnected (387), and the roller advanced by a predetermined number of encoder counts to lower the service station sled and home the rocker arm position (388).

The capping routine 390 is shown in FIG. 19A. At 392, the carriage drive is connected, and the carriage is then moved to the capping position, where the caps on the service station are directly located below the nozzle plates of the pens (394). The roller drive is then connected (396), and the roller is driven backwards by a predetermined number of encoder counts to activate the rocker gear and the activation gear, lifting the service station sled fully to position the caps against the nozzle plates (398). Now the caps will not drop even if power is removed from the printer, since the worm gear is self-locking, and the forces on the rocker gear are such that the rocker gear is locked in position also.

Figure 19:
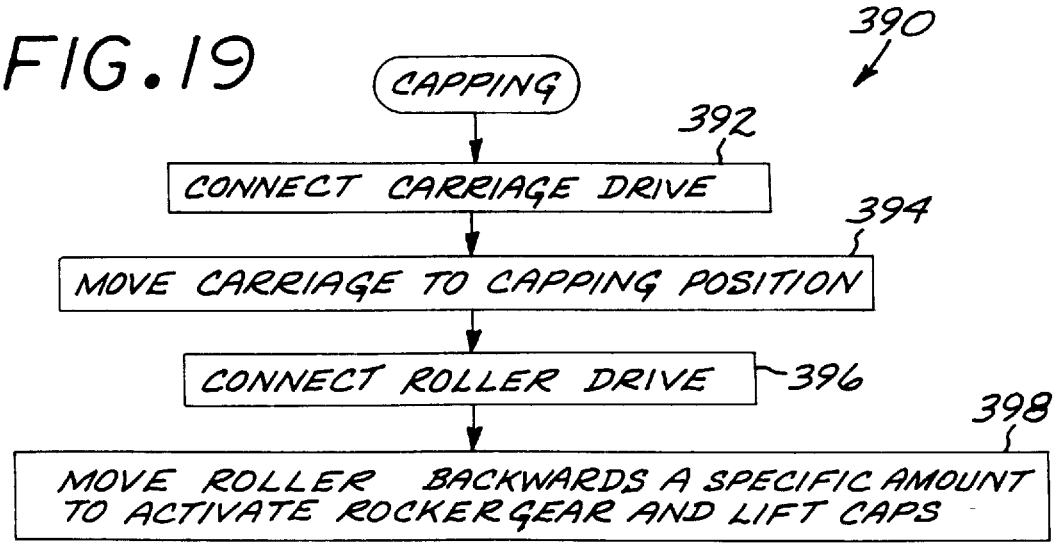
Figure 20:
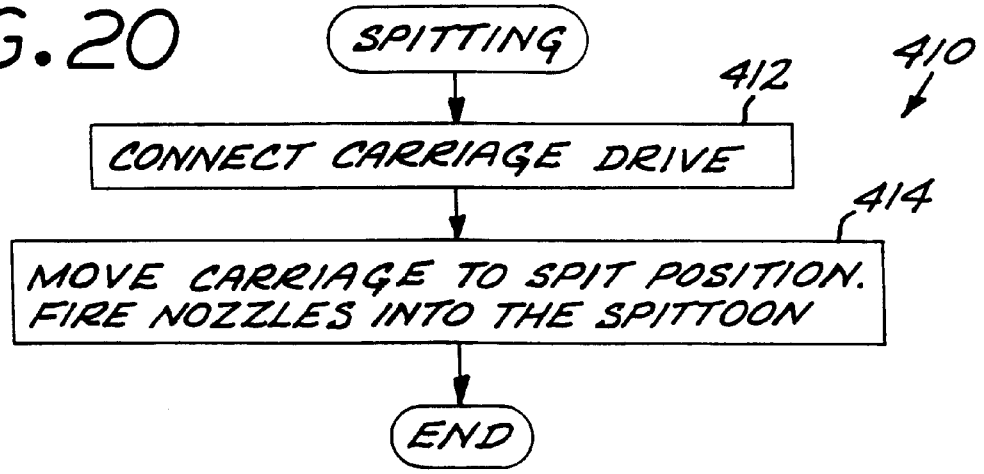

The printer also includes a spittoon located at each end of the travel position of the carriage, and a spitting routine 410 can be performed to unblock nozzles while a printing operation has commenced. This routine is shown in FIG. 19, and includes the steps of connecting the carriage drive (412), and moving the carriage to a spitting position, where the spittoons are positioned directly below the nozzle plates. The nozzles are then fired (414) to clear any blocked nozzles.

A printer has been disclosed in which the pens are immobile, and a media carriage moves the medium in two axes to achieve the necessary relative motion between the print medium and the pens during printing operations. This architecture provides a number of advantages over a conventional architecture in which the pens are mounted on a pen carriage for translating movement along one axis, and the media is moved along a second, transverse axis. One advantage is reduced cost. This can be achieved by using immobile pens which are centrally located, allowing the reduction or elimination of cables and connectors typically used to connect the carriage mounted pens to the printer controller mounted on a printed circuit board. This is schematically illustrated in FIG. 2, wherein the circuit board 55 is schematically illustrated behind the pen mount structure, and is electrically attached to the pens connecting circuitry via a short ribbon cable 57. The pens are removable, and include a TAB circuit which mates with a corresponding pen mount circuit when the pens are installed in the pen mount. The pen mount circuit is connected to the short ribbon cable 57. Such a short cable is much less expensive than the long trailing cable typically used to connect between a circuit board and the carriage of a moving pen carriage architecture.

Another advantage is that the mass of the carriage 60 can be much less than the mass of a typical moving pen carriage and the pens held on the carriage. This reduction in mass allows reduction in motor sizes and/or decreases the distance needed to accelerate to print speed, keeping hardware width smaller. This becomes particularly significant as inkjet pen firing frequencies increase.

A further advantage is that the printer width needed to enclose only the nonmoving subsystems of the printer, e.g., the pens, electronics and motors, is reduced over the convention printer architecture. The media carriage transports the medium outside the static hardware envelope width. The printer width is relatively insensitive to the size and number of pens used on the printer.

Another advantage is that the translating media carriage facilitates the use of several paper pick and stacking locations. On moving pen printers, the paper input trays are typically aligned with the drive roller to allow the paper to be picked and rolled directly onto the drive roller. With the new printer architecture, the drive roller travels on the media carriage and may be aligned with one or more paper input trays distributed along the length of travel. Paper output stacks can likewise have multiple locations across the width of the printer.

It is understood that the above-described embodiments are merely illustrative of the possible specific embodiments which may represent principles of the present invention. Other arrangements may readily be devised in accordance with these principles by those skilled in the art without departing from the scope and spirit of the invention. For example, while the disclosed embodiment of FIG. 1 has employed a two-axis drive wherein a single motor is used to drive in both axis, other arrangements can use two motors, one to drive the carriage linearly, the other to rotate the drive roller and service functions including the ASF, service station and paper eject functions. The two-motor drive system would be somewhat more costly, and would use two encoders, but could have improved performance in some aspects. Another alternative is to use stepper motors instead of de motors.

What is claimed is:

1. An ink-jet printer, comprising:

a printer housing structure;

at least one immobile inkjet pen including a nozzle array mounted to the housing structure at a print area, the pen remaining stationary during printing operations;

a two axis media drive system, including a media drive roller structure which is rotatable to move a medium in a first axis relative to the print area to position the medium relative to the pen nozzle array for a given swath, a translating media carriage, the drive roller structure supported by the media carriage, the carriage mounted for translating movement along a second axis transverse to said first axis, to slew the media along said second axis at print speed during printing, and a motor system for rotating the media drive roller structure and for translating the carriage.

2. The printer of claim 1 wherein the drive system comprises:

a drive motor; and a drive transmission connected between the motor and the media carriage, the drive transmission operable in a first mode to slew the carriage linearly while holding the drive roller in a rotationally fixed position, and in a second mode to rotationally drive the roller structure about a drive roller axis while holding the carriage in a fixed position.

3. The printer of claim 2 wherein the drive transmission includes a brake system for selectively locking the position of the carriage when the transmission is in the second mode.

4. The printer of claim 3 wherein the brake system includes a drive roller locking apparatus for locking the position of the drive roller when the transmission is in the first mode.

5. The printer of claim 2 wherein the drive transmission comprises an endless belt reeved around a pulley system, the pulley system including a drive pulley driven directly by the drive motor, a first carriage pulley mounted on the carriage and a second carriage pulley mounted on the carriage, a first idler pulley mounted on the printer housing structure and a second idler pulley mounted on the printer housing structure and spatially separated from the first idler pulley.

6. The printer of claim 5 wherein the drive transmission includes a brake structure for preventing said first carriage pulley from rotating while the transmission is in the first mode, wherein rotation of said drive pulley operates to impart translational forces to said carriage to drive the carriage along the second axis.

7. The printer of claim 6 wherein the brake structure includes a brake element movable between a first position and a second position, wherein the brake element locks the first carriage pulley in a non-rotating position when in the first brake position during the first mode, and when in the second position locks the carriage in a given position along the second axis during the second mode.

8. The printer of claim 7 wherein the brake structure further includes a brake motor fixedly mounted on the housing structure, a brake link mounted to the housing structure and movable between a first position out of engagement with said brake element and a second position in engagement with said brake element, and a brake gear coupling the brake motor to the brake link to drive the brake link between the first and second positions.

9. The printer of claim 5 wherein the first carriage pulley is coupled to a roller drive gear train to impart rotational forces to the drive roller structure during said second mode.

10. The printer of claim 5 wherein the endless belt is a toothed belt, and said drive pulley is a toothed pulley.

11. The printer of claim 5 further comprising a single encoder sensor for providing sensor data indicative of rotation of the drive motor.

12. The printer of claim 1 wherein the drive roller structure includes a roller shaft, and first and second roller tires mounted on the roller shaft in a spaced arrangement, each of the roller tires having a surface for engaging the print media.

13. The printer of claim 1 further including a printer main circuit board positioned adjacent a mounting location for the pens, and a short flexible cable connected between the circuit board and the mounting location.

14. An ink-jet printer, comprising:

a printer housing structure;

at least one immobile ink-jet pen including a nozzle array mounted to the housing structure at a print area, the pen remaining stationary during printing operations;

a two axis media drive system, including a media drive roller structure which is rotatable to move a medium in a first axis relative to the print area to position the medium relative to the pen nozzle array for a given swath, a translating media carriage, the drive roller structure supported by the media carriage, the carriage mounted for translating movement along a second axis transverse to said first axis, to slew the media along said second axis at print speed during printing, a single drive motor, and a drive transmission operable in a carriage drive mode and in a roller drive mode, the transmission coupling the drive motor to the carriage and the media drive roller structure for rotating the media drive roller structure and for translating the carriage; and a controller for controlling the drive motor and the drive transmission.

15. The printer of claim 14 further comprising a single encoder sensor for providing sensor data to said controller indicative of rotation of the drive motor, said controller responsive to the sensor to operate the drive motor when the drive transmission is in the carriage drive mode and when the drive transmission is in the roller drive mode.

16. A method for ink-jet printing, comprising:

providing an inkjet pen having an inkjet nozzle array plate;

mounting the inkjet pen at an immobile position on a printer;

providing a carriage including a platen surface for supporting a print medium during printing operations, the carriage including a rotatable drive roller engaging the print medium;

moving the carriage and the print medium along a linear swath axis in relation to the nozzle array plate while holding the drive roller in a rotationally fixed position and operating the inkjet pen to eject droplets of ink to print at least a portion of a swath on the print medium;

rotating the drive roller to advance the print medium to a location for printing another swath; and while holding the drive roller in a rotationally fixed position, moving the carriage and the print medium along the linear swath axis to print at least a portion of another swath on the print medium.

* * * * *